United States Patent [19]

Lefler et al.

[11] 4,379,590

[45] Apr. 12, 1983

[54] VENTILATION AIR AND PROCESS AIR DISTRIBUTION FOR IN SITU OIL SHALE RETORTS

[75] Inventors: C. Arthur Lefler, Casa Grande, Ariz.; John E. McCarthy, Palos Verdes, Calif.; Gordon B. French, Bakersfield, Calif.; Eugene A. Mills, Whittier, Calif.; David E. Miall, Lafayette, La.

[73] Assignee: Occidental Oil Shale, Inc., Grand Junction, Colo.

[21] Appl. No.: 165,081

[22] Filed: Jul. 1, 1980

Related U.S. Application Data

[63] Continuation of Ser. No. 24,459, Mar. 27, 1979, abandoned, which is a continuation of Ser. No. 892,652, Apr. 13, 1978, abandoned, which is a continuation of Ser. No. 768,878, Feb. 15, 1977, abandoned.

[51] Int. Cl.[3] ..... E21C 41/10

[52] U.S. Cl. ..... 299/2; 299/19

[58] Field of Search ..... 219/4, 5, 2, 19; 166/251; 98/50

[56] References Cited

U.S. PATENT DOCUMENTS

| | | | |
|---|---|---|---|
| 2,481,051 | 9/1949 | Uren | 299/2 |
| 3,586,377 | 6/1971 | Ellington | 299/2 |
| 4,017,719 | 4/1977 | Lewis | 299/2 |
| 4,018,280 | 4/1977 | Daviduk et al. | 299/2 |
| 4,027,917 | 6/1977 | Bartel | 299/2 |

OTHER PUBLICATIONS

Technical and Economic Study of Underground Mining Rubblization and in Situ Retorting System for Deep Oil Shale Deposits, Stone et al., NTIS PB-249, 344, pp. 99-103.

*Primary Examiner*—William F. Pate, III

*Attorney, Agent, or Firm*—Christie, Parker & Hale

[57] ABSTRACT

A ventilation and process air distribution system is provided for an in situ oil shale retort system which includes a production region having a cluster of retorts producing gaseous and liquid products and a retort preparation region where in situ retorts are being prepared for production. An underground air delivery drift system distributes process air to the production region and ventilation air to underground workings in the retort preparation region. A liquid collection drift system extends at or below the bottoms of the retorts in the production region and in the retort preparation region. The liquid collection drifts connect to an exhaust airway leading above ground and having an induction fan for inducing ventilation air to flow through the retort preparation region at a pressure lower than ambient air pressure above ground. A gas collection level located below the retorts connects to a product gas way leading above ground and having a centrifugal fan for withdrawing off gas from the retorts in the production region at a pressure lower than that of the ventilation air, which continually draws process air from the air delivery drifts into active retorts to promote combustion in the retorts. The suction produced in the exhaust airway and the product gas airway continually draws fresh air into an inlet airway at ambient air pressure above ground for distribution as process air and ventilation air.

26 Claims, 6 Drawing Figures

VENTILATION AIR AND PROCESS AIR DISTRIBUTION FOR IN SITU OIL SHALE RETORTS

CROSS REFERENCE TO RELATED APPLICATIONS

This is a continuation of application Ser. No. 24,459, filed Mar. 27, 1979, now abandoned which, in turn, is a continuation of Ser. No. 892,652, field Apr. 3, 1978, now abandoned, which, in turn, is a continuation of Ser. No. 768,878, filed Feb. 15, 1977, now abandoned.

BACKGROUND OF THE INVENTION

The presence of large deposits of oil shale in the Rocky Mountain region of the United States has given rise to extensive efforts to develop methods of recovering shale oil from kerogen in the oil shale deposites. A number of methods have been developed for processing the oil shale which involve either first mining the kerogen bearing shale and processing the shale on the surface, or processing the shale in situ. The latter approach is preferable from the standpoint of environmental impact inasmuch as the spent shale remains in place, reducing the chance of surface contamination and the need to dispose of solid wastes.

The recovery of liquid and gaseous products from a subterranean formation containing oil shale has been described in several issued patents, one of which is U.S. Pat. No. 3,661,423, issued May 9, 1972, to Donald E. Garrett, assigned to the assignee of this application, and incorporated herein by reference. That patent describes the in situ recovery of liquid and gaseous carbonaceous products from subterranean formations containing oil shale by preparing an in situ oil shale retort in the subterranean formation. The retort is formed by excavating a production tunnel or drift in the subterranean formation, mining a void in the formation within the boundaries of the in situ oil shale retort being formed, and explosively expanding formation toward the void. This forms a fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying the hot retorting gases used for converting kerogen contained in the oil shale, as described in U.S. Pat. No. 3,661,423, includes the establishment of a combustion zone in the retort and the movement of an oxygen supplying gaseous feed mixture into the combustion zone to advance the combustion zone through the retort. In the combustion zone, oxygen in the gaseous feed mixture is depleted by reaction with hot carbonaceous materials to produce heat and combustion gas. By the continued introduction of the oxygen supplying gaseous feed mixture into the combustion zone, the combustion zone is advanced through the retort.

The combustion gas and the portion of the gaseous feed mixture which does not take part in the combustion process pass through the retort on the advancing side of the combustion zone. This heats the oil shale in a retorting zone to a temperature sufficient to produce kerogen decomposition, called retorting, in the oil shale to gaseous and liquid products and a residue of solid carbonaceous material.

The liquid and gaseous products are cooled by the cooler oil shale particles in the retort on the advancing side of the retorting zone. The liquid carbonaceous products, together with water, are withdrawn from the bottom of the retort through the production drift. A process off gas is withdrawn from the bottom of the retort through the production drift. The off gas includes combustion gas generated in the combustion zone, gaseous products produced in the retorting zone, gas from carbonate decomposition, and gaseous feed mixture that does not take part in the combustion process.

The off gas contains nitrogen, hydrogen, carbon monoxide, carbon dioxide, water vapor, methane and other hydrocarbons, and sulfur compounds such as hydrogen sulfide. Hydrogen sulfide is an extremely toxic gas with a toxicity greater than that of hydrogen cyanide. It also possesses a powerful, objectionable odor with a threshold for human smell of about 0.0003 ppm. In addition, carbon monoxide contained in off gas is toxic. For this reason it is desirable to ventilate the retort preparation or development region of the formation so that workers are isolated from the off gas. This has been difficult to accomplish because the production tunnel or drift is used for two functions. It is used for excavating formation to prepare new in situ oil shale retorts in a retort preparation region of the formation, and at the same time it is used for withdrawing off gas from active retorts in a producing region of the formation.

A large quantity of process air is used in sustaining and advancing a combustion zone through the fragmented mass in an in situ oil shale retort and a number of retorts are operated at the same time for obtaining substantial production of shale oil. This process air is delivered continually to active retorts.

Therefore, there is a need to effectively distribute process air to active retorts in the production region of the formation and to distribute ventilation air to underground workings in the development regions of the formation. There is also a need for a ventilation system in a subterranean oil shale formation which avoids the danger of exposing workers to the off-gas while liquid and gaseous products from oil shale are being recovered in nearby regions of the formation.

SUMMARY OF THE INVENTION

This invention provides a method for recovering liquid and gaseous products from a plurality of in situ oil shale retorts in a subterranean formation containing oil shale, in which ventilation air is provided for underground workings and process air is provided for a plurality of in situ oil shale retorts each containing a fragmented permeable mass of formation particles containing oil shale. The method includes the steps of withdrawing ventilation air from underground workings at a first pressure lower than ambient air pressure above ground, withdrawing process off gas from a plurality of in situ oil shale retorts at a pressure lower than air pressure in the underground workings for drawing process air from underground workings into the retorts, and introducing ventilation air and process air into the underground workings at an inlet pressure substantially the same as ambient air pressure above ground.

Exemplary of a method of distributing process air to active in situ oil shale retorts in a production region and ventilation air to underground workings in a retort preparation region of the formation, upper level and lower level underground workings are provided together with a first inlet airway between above ground and at least the upper level workings, and a second exhaust airway is provided between above ground and at least the lower level workings. Air communication is established between the upper level and lower level workings, and ventilation air is withdrawn from the exhaust airway to draw fresh air through the inlet airway, through the upper level workings, through the air communication between the upper and lower level workings, and through the lower level workings. A plurality of in situ oil shale retorts are formed between the upper level workings and the lower level workings, each retort containing a fragmented permeable mass of formation particles containing oil shale. Air communication is established between the upper level workings and the top of each retort, and a combustion zone is established in each retort having air communication to the upper level workings. Process off gas containing gaseous products is withdrawn from the bottom of the retorts having combustion zones for drawing process air through the inlet airway and the upper level workings into the retorts to advance the combustion zones downwardly through the fragmented mass in each retort so as to retort oil shale in the retorts. The process off gas is withdrawn at a pressure lower than air pressure in the underground workings, and liquid products are withdrawn from the bottom of each retort having a combustion zone.

Inasmuch as process off gas is withdrawn at a lower pressure than the exhaust ventilation air, workers in the retort preparation region of the formation are prevented from being exposed to off gas generated in the production region. Further, exhaust ventilation air and process off gas are continuously withdrawn from separate airways at separate pressures both lower than ambient air pressure above ground. This draws fresh air through the subterranean workings from above ground and enables the air to be effectively distributed as process air or ventilation air at desired gas pressures within the production and retort preparation regions of the formation.

These and other aspects of the invention will be more fully understood by referring to the following detailed description and the accompanying drawings.

DRAWINGS

DESCRIPTION

With reference to the drawings, a method according to this invention for distributing process air and ventilation air to a subterranean formation 10 containing oil shale includes retort preparation in a retort preparation or development region 11 of the formation and production of gaseous and liquid products in a production region 13 of the formation. Retort preparation and production can occur simultaneously. Each of these operations will now be described.

Figure 2:
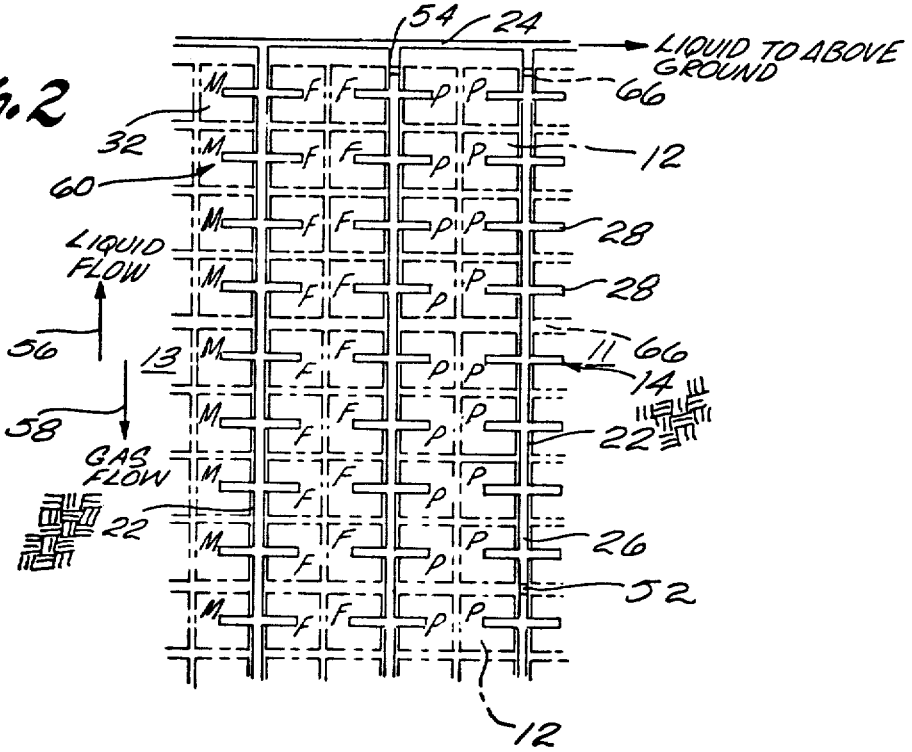
FIG. 2 is a plan view showing a liquid collection level of the subterranean formation of FIG. 1 taken on line 2—2 of FIG. 1.
Figure 3:
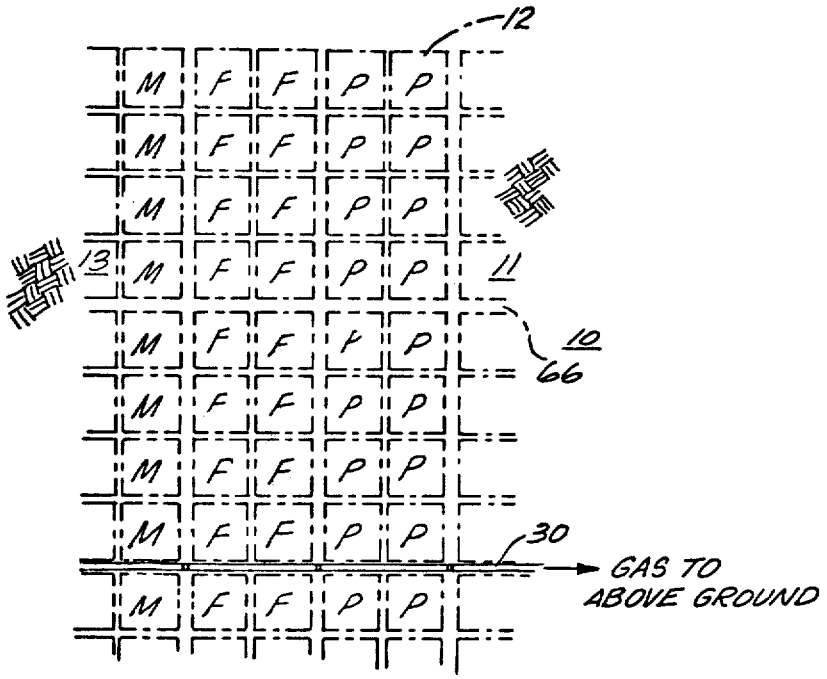
FIG. 3 is a plan view showing a gas collection level of the formation of FIG. 1 taken on line 3—3 of FIG. 1.
Figure 5:
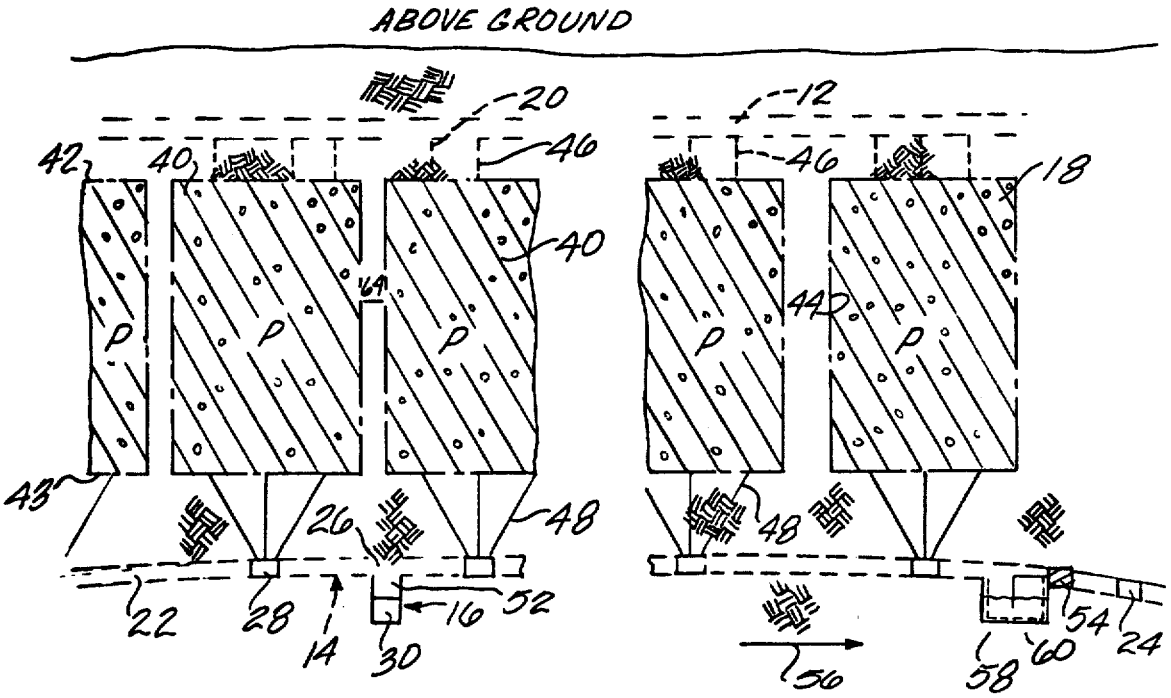
FIG. 5 is a view similar to that of FIG. 4 taken on line 5—5 of FIG. 1.
Figure 6:
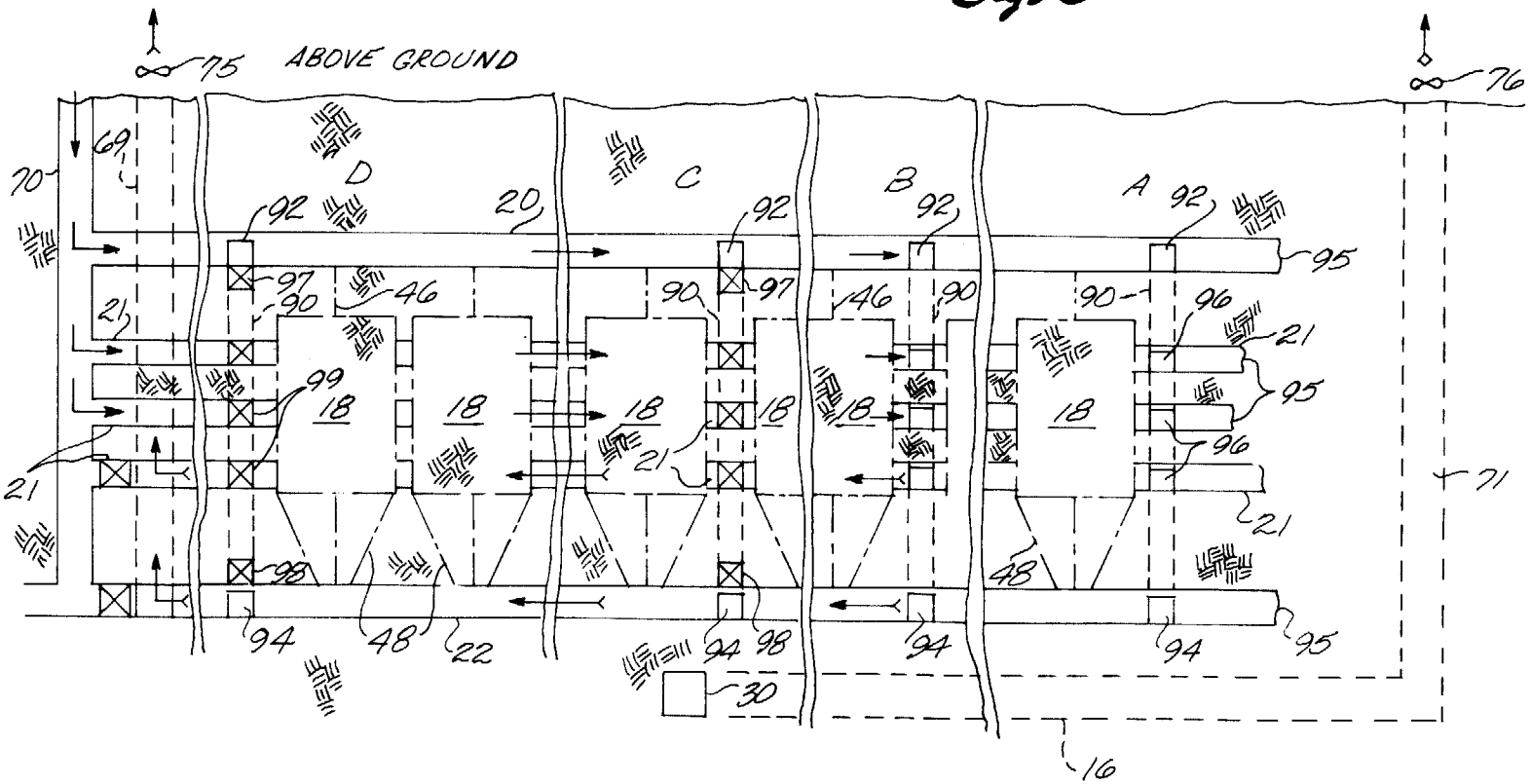
FIG. 6 is a schematic view in vertical cross-section showing a bypass raise system for use in removing muck from underground workings and for distributing ventilation air to the workings in regions of the formation under development.

As part of the retort preparation operation, at least three drift systems or levels are prepared in the subterranean formation 10, including an air level 12, a liquid collection or production level 14, and a gas collection level 16. One or more retort access levels 17 also can be provided. The retort access level is not shown in FIGS. 4 and 5; three retort access levels 17 are illustrated in FIG. 6. Plan views of a portion of the liquid collection level 14 and a portion of the gas collection level 16 are shown in FIGS. 2 and 3, respectively. As used herein, the term "level" means one or more generally horizontally extending passages or drifts.

Figure 1:
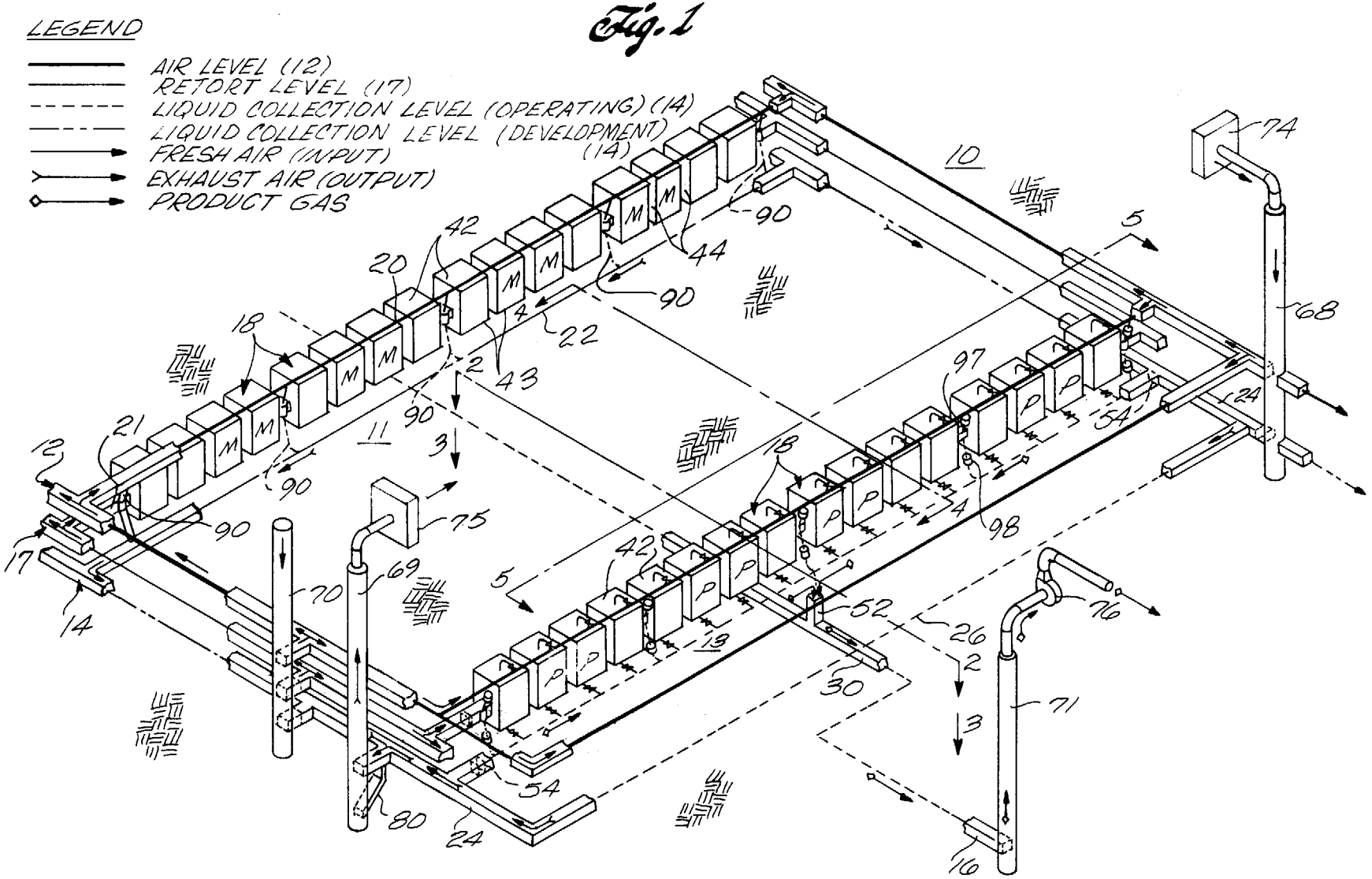
FIG. 1 is a schematic perspective view showing a subterranean formation containing oil shale partially prepared for in situ retorting and having a system for distributing process air to oil shale retorts in production and for supplying ventilating air to a region of the formation where in situ retorts are being developed.

The air level 12 is an air delivery drift system prepared in unfragmented formation 10 at an elevation higher than that of the upper boundaries 42 of a plurality of in situ oil shale retorts 18 to be formed in the formation. The liquid collection level 14 is a drift system at an elevation below the elevation of the bottom boundaries 43 of the in situ oil shale retorts 18, and the gas collection level 16 is at an elevation lower than the elevation of the liquid collection level 14. The retort access level 17 is a drift system at an elevation between the upper and lower boundaries of the retorts 18. For clarity, only a portion of the retorts 18 are shown in FIG. 1 and portions of the levels are shown by lines as indicated in the drawing legend.

Access to each of the levels from above ground for preparation of the levels is achieved by means of one or more access shafts. The shafts provided are an emergency escape way and ventilation shaft 68, a production shaft 69, a service shaft 70, each of which serves as an airway, and a product gas shaft 71. The emergency ventilation shaft 68, production shaft 69, and service shaft 70 each provide access to the air level 12, liquid collection level 14, and retort preparation level 17 for preparation of retorts in the subterranean formation. Only the product gas shaft 71 provides access to the gas level 16 and the gas shaft is isolated from underground workings on the other levels by unfragmented formation.

In addition to providing access to the levels in the formation during retort preparation operations, the shafts also are used during production operations. The production shaft 69 is used for ventilation exhaust and liquid product removal. A muck loading facility 80, indicated schematically in FIG. 1, is provided at the bottom of the production shaft for removing excavated formation as well as removing fragmented formation produced in excavating the levels and voids within the retorts being formed. The service shaft 70 provides an airway for intake of process and ventilation air. The product gas shaft 71 is used for withdrawing gaseous products from the subterranean formation. The emergency ventilation shaft 68 is used to provide additional mine ventilation air and serve as an emergency escape way. The emergency ventilation shaft 68 can be equipped with an axial vane fan or blower 74 to provide some ventilation air.

Primary ventilation air and process air enter the levels through the service shaft 70, and ventilation air is withdrawn from the levels through the production shaft 69 by an axial vane blower 75 above ground level connected to the production shaft 69. Fresh air used for ventilation and process air is pulled into the levels from above ground through the production shaft 69 under negative pressure (lower than ambient air pressure) provided by the fan 75. A centrifugal blower 76 positioned above ground and connected to the product gas shaft 71 withdraws process off gas from active retorts in the production region 13 at a negative pressure lower than the pressure of ventilation air flowing through the retort preparation region 11 and process air flowing to retorts in the production region.

The air level 12, the retort access level 17, and the liquid collection level 14 each comprises a plurality of parallel, vertically spaced apart cross drifts 20, 21 and 22, respectively. There are one or more vertically spaced apart retort access drifts 21 for each row of retorts. Each liquid collection cross drift 22 is between two rows of retorts and is substantially directly below an air cross drift 20. A liquid collection cross drift 22 and an air cross drift 20 are provided for each two rows of retorts. Only one row of retorts is illustrated in each region of FIG. 1 for clarity. At each end of the liquid collection cross drifts 22 there is a main liquid collection drift 24 which is generally perpendicular to the liquid collection cross drifts 22. As shown most clearly in FIG. 5 there is a slight pitch or slope in each liquid collection cross drift 22 from its longitudinal center 26 toward each of the main liquid collection drifts 24, so liquid produced during the production operation flows towards the main collection drifts. The pitch in the cross drifts of the liquid collection level can follow the bedding plane of the formation toward at least one end of the cross drift.

Each air drift 20 of the air delivery drift system and each cross drift 22 of the liquid collection system serves two rows of retorts 18. As shown best in FIG. 2, from each such cross drift of the liquid collection system, a stub drift 28 which can be blocked to gas flow is driven for each of the retorts to below the center point of the retort. Each stub drift is substantially perpendicular to the longitudinal axis of the cross drift from which it is driven. The stub drifts are used to collect liquid and gaseous products from the retorts and convey the products to a cross drift 22 which, in turn, conveys liquid products to a main liquid collection drift 24 and gaseous products to the gas collection drift system 14.

The gas collection drift system 14 comprises a single drift 30 which extends longitudinally in a direction parallel to that of the main drifts 24 of the liquid collection systems. The drift 30 also extends below the center 26 of each of the cross drifts 22 of the liquid level. The gas collection drift 30 is dedicated to collecting gas from active retorts in the producing region of the formation. The gas collection drift 30 can be smooth-lined with a material such as concrete to withstand corrosive effects of the gaseous products and to avoid seepage of the gas into areas in which personnel are working as well as leakage of air and water into the gas level.

All four levels and all shafts can be prepared with conventional excavating equipment according to standard mining techniques.

To prepare a retort, formation from within the boundaries of an in situ oil shale retort being prepared is excavated or mined to a liquid collection drift to form a least one void, thereby leaving a second portion of the formation within the boundaries of the in situ oil shale retort prepared. Excavated formation removed at a retort preparation level 17 can be passed to the liquid collection or production level 14 by bypass raises 90. The excavated formation is transferred from the liquid collection level to above ground by way of the production shaft. This operation occurs in the retort preparation 11 region of the formation. Retorts being formed in the retort preparation region 11 are indicated with the letter "M" in the drawings.

A variety of mining schemes can be used for preparation of the retorts. For example, the method described in the aforementioned U.S. Pat. No. 3,661,423 can be used. According to this method, an undercut or void is excavated to the length and width of the in situ oil shale retort being formed. A plurality of small support pillars are left in the undercut. Only a limited height of the formation is excavated, generally from about 5% to about 25% of the formation within the boundaries of a retort being formed. This method does not require a retort access level 17 with retort access drifts 21. The undercut can be excavated from the liquid collection level, which can be at an elevation at the elevation of the bottom boundary of the retort being formed.

Alternatively one or more horizontal voids can be excavated within the boundaries of the in situ oil shale retort being formed, as described in U.S. patent application Ser. No. 659,899, filed on Feb. 20, 1976, assigned to the assignee of this application, and incorporated herein by reference. If more than one horizontal void is excavated within the boundaries of the in situ oil shale retort being formed, more than one retort access level 17 having retort access drifts 21 can be required, as more fully described in U.S. patent application Ser. No. 659,899. Alternatively, one or more columnar voids, each void having a vertically extending free face can be excavated in the subterranean oil shale formation as described in U.S. patent application Ser. No. 603,704, filed on Aug. 11, 1975, assigned to the assignee of this invention, and incorporated herein by reference. The columnar void can be cylindrical or a slot having one or more large parallel, planar vertical free faces.

After excavating one or more voids, remaining formation within the boundaries of an oil shale retort being formed is fragmented by explosive expansion toward such a void to form a fragmented permeable mass of formation of particles containing oil shale. Each retort 12 designated by the letter "F" in the drawings contains a fragmented permeable mass of formation particles containing oil shale, and has top 42, bottom 43 and side 44 boundaries of unfragmented formation. Between adjacent retorts is left a zone of unfragmented formation serving as a pillar 64 to at least partly support overlying formation and as a gas barrier to prevent flow of gases between adjacent retorts.

Figure 4:
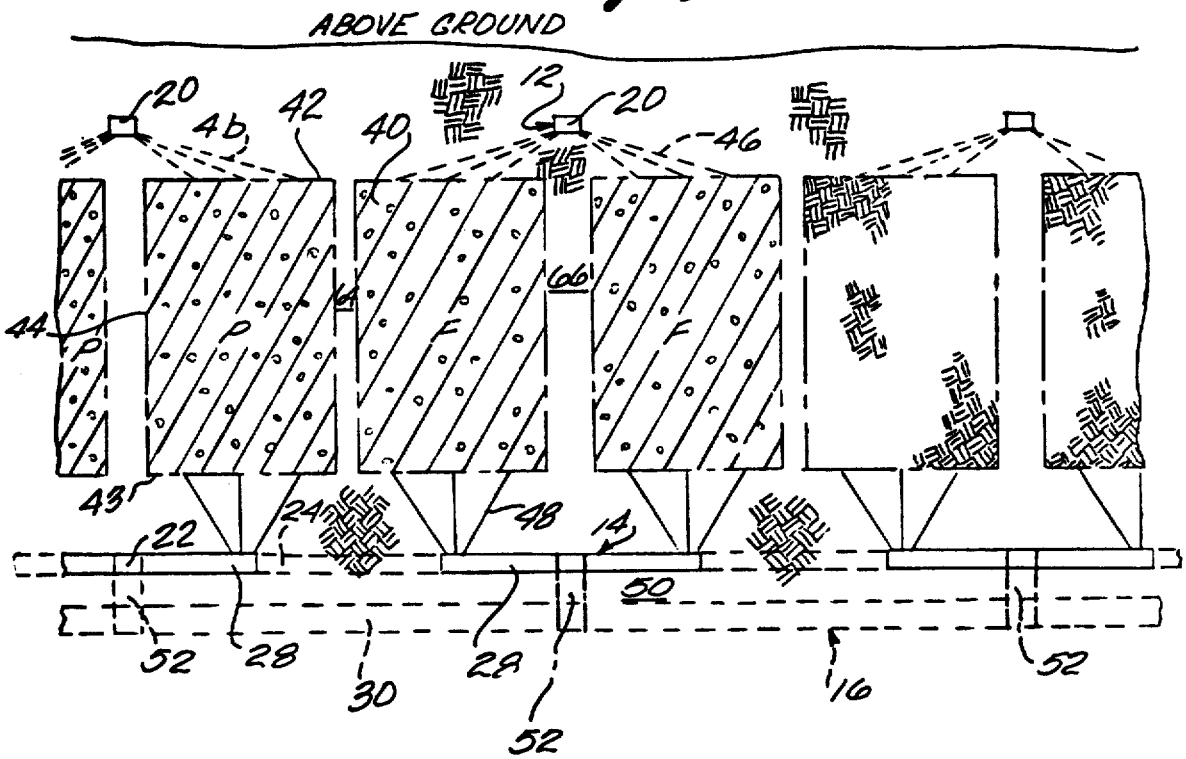
FIG. 4 is a schematic view in vertical cross-section of the formation taken on line 4—4 of FIG. 1.

After fragmentation is completed, the final preparation steps for producing liquid and gaseous products from a retort are carried out. These include drilling a plurality of feed gas inlet passages 46 downwardly from the air drift 20 to the upper boundary 42 of a retort so oxygen containing gas can be supplied to the retort during the production operation. Similarly, a plurality of bore holes or raises 48 are drilled upwardly from the liquid collection level 14 to the bottom boundary of each retort for removal of liquid and gaseous products from the retorts to the liquid collection level. The bottom bore holes 48 can be fan drilled upwardly in a five-spot, or as shown in FIGS. 4 and 5, a nine-spot pattern. The bottom bore holes 48 for each retort 18 are drilled from the end of a stub drift 28.

Explosives are placed in the portion of the formation 50 (FIG. 4) between the gas collection drift 30 and the mid-point 26 of each cross drift 22 of the liquid collection drift system 14 for blasting the formation to provide a raise or winze 52 between the gas and liquid collection levels. A pit (not shown) can be excavated in the floor of the gas collection drift below the winze 52 so rubble resulting from blasting formation to form the winze can fall into the pit and not obstruct gas flow in the gas collection. A gas impervious barrier or stoppage, such as a bulkhead 54, is provided at each end of the cross drift 22 of the liquid collection level and each cross drift 21 of the retort access level 17. The bulkheads prevent gas produced during production operations from entering those portions of the liquid collection and retort access drift systems where mining and fragmenting operations are occurring. Such bulkheads are installed after all of the retorts communicating with the respective cross drift are completed and ready for retorting. After the bulkheads are in place, explosives in the formation 50 between the gas and liquid collection levels can be detonated to provide the raises 52 for passing gaseous products from the liquid collection level 14 to the gas collection level 16.

Retorts which have been completely formed are designated by the letter "F" in the drawings.

During the production operation, a combustion zone is established in retorts marked with the letter "P" in the drawings. The combination zone advances downwardly through the retort by introducing as a combustion zone feed a gaseous feed containing an oxygen-supplying gas. The combustion zone feed is introduced into the retorts through the air drift 20 and down through the feed gas inlet passages 46. The combustion zone feed can contain air, or air mixed with other gases, such as gas produced during the production operation, steam, or an inert gas such as nitrogen. As the combustion zone feed is introduced to the retort 18, oxygen oxidizes carbonaceous material in the oil shale to produce a combustion gas. Heat from the exothermic oxidation reactions carried by flowing gases advances the combustion zone downwardly through the fragmented permeable mass of particles.

Combustion gas produced in the combustion zone and any unreacted portion of the oxygen-supplying gaseous feed pass through the fragmented mass of particles on the advancing side of the combustion zone to establish a retorting zone on the advancing side of the combustion zone. Keorgen in the oil shale is retorted in the retorting zone to produce liquid and gaseous products.

The liquid products and an off gas containing gaseous products pass through the bottom bore holes 48 to the stub drift of the liquid collection level and advance to the cross drifts 22. Because of the pitch or slope of the cross drifts 22, liquid products flow toward the ends of the cross drifts as indicated by arrow 56 in FIG. 2. The liquid products are collected in a sump 58 provided at each end of the liquid collection drift upstream of the bulkhead 54. A conduit 60 extending from the sump 58 through the bulkhead 54 is used for withdrawing liquid products into a main liquid collection drift 24 as well as for passing the liquid products to above ground. A pump (not shown) is used for passing liquid products to the surface.

An off gas containing gaseous products, combustion gas, gas from carbonate decomposition, and any unreacted portion of the oxygen supplying gaseous feed is also present in the stub drift 28 and the cross drifts 22. The bulkheads 54 at the ends of the cross drifts 22 prevent the off gas, which contains toxic compounds such as carbon monoxide and sulfur such as hydrogen sulfide, from entering the main liquid collection drift 14 and other portions of the liquid collection level where retort preparation is occurring. Instead, off gas is withdrawn to the liquid collection level 16 via the raises 52 connecting the gas and liquid collection levels, and from the gas collection level the off gas is passed to above ground.

Preferably, off gas containing gaseous products is withdrawn through the liquid collection level and gas level by a pump, such as the centrifugal blower 76, which has a substantial pressure gain. This maintains the pressure in the gas collection level lower than the pressure in the liquid collection level, and particularly the portion of the liquid collection level in the retort preparation region formation where operating personnel are present. Thus, if a gas leak were to occur in a region containing off gas, such a leak would result in leakage of gas into the gas collection system, rather than leakage of toxic off gas out into a region in which operating personnel are working.

The directions of liquid flow in the liquid collection level and gas flow in the liquid collection level are indicated in FIG. 2 by arrows 56 and 59, respectively.

It should be understood that although the invention has been described in terms of the steps of level preparation, mining, fragmentation, and producing being carried out successively, in practice the steps can be carried out simultaneously. That is, only a portion of each level can be prepared, and simultaneously with preparation of the levels, mining, fragmentation, and production of liquid and gaseous product are carried out. For example, as shown in the drawings, simultaneously with the production of gaseous and liquid products in retorts "P", fragmentation of formation and mining of formation are occurring in the retorts labeled "M". However, the gas collection level is preferably completed, sealed, and dedicated to gas withdrawal before a combustion zone is established in any of the retorts in the subterranean formation 10 so operating personnel are not exposed to toxic off gas produced during the production operation.

As used herein, the term "production region" refers to a region of the subterranean formation 10 in which liquid and/or gaseous products are being produced from oil shale. The terms "retort preparation region" or "development region" refer to a region of the subterranean formation 10 where retorts are being formed and formation is being prepared for production of liquid and gaseous products. Such region includes regions of the formation where drift systems are being prepared, formation is being excavated, formation is being fragmented, and/or a base of operations is located. Thus, with reference to the drawings, retorts labeled "P" are in the producing region. The portion of the formation containing retorts which are not yet completely formed, which are labeled "M", is in the retort preparation or development region, inasmuch as fragmentation of formation to prepare in situ oil shale retorts has not yet been completed. The region of the formation containing retorts labeled "F" serves as a buffer region between the retort preparation region 11 and the production region 13. Formation of the retorts in the buffer region is complete, i.e., all steps necessary to establish a combustion zone in the retorts have been completed. The buffer region of the formation helps prevent any gas which may leak from producing retorts from entering the retort preparation region where operating and mining personnel are working.

Preferably, liquid and gaseous products are withdrawn from a retort to the liquid collection level and then gaseous products are passed to the gas collection level from the liquid collection level. Thus, there is no direct fluid communication between the gas collection level and the retort. All fluid communication between the retorts and the gas level is through the liquid level. Alternately, the gaseous and liquid products can be withdrawn directly to a gas collection level, and from the gas collection level, the liquid products can be passed to a liquid collection level. In this latter instance, the liquid collection level is not in direct fluid connection with the retorts. As a further alternative, liquid products can be withdrawn directly to the liquid collection level and gaseous products can be withdrawn directly to the gas collection level.

As shown in FIGS. 4 and 5, the bottom boundaries of the retorts can be at substantially the same elevation, with the elevation of the liquid collection level being lower than the elevation of the bottom boundaries of the retorts, and the elevation of the gas collection level being lower than the elevation of the liquid collection level. Alternately, the elevation of the liquid collection level can the same as the elevation of the bottom boundaries of the retorts.

It is preferred that the gas level be at a lower elevation than the liquid collection level in which men are required to work in excavating for formation of retorts. Oil shale is found in stratified deposits and in many cases the deposits have substantially horizontal bedding planes. During the excavation of the underground workings and formation of retorts, there is considerable blasting with some likelihood of producing cracks in the formation through which gases might pass. Such damage to the rock structure can occur along the bedding planes. It is therefore desirable to have the gas collection level at an elevation different from the liquid collection level.

Further, the liquid collection level should be relatively near the bottoms of the retorts being formed since this assists in excavation and formation of retorts. Placement of the gas collection level at an elevation above the liquid level through which formation is excavated would place the gas collection level in regions to be occupied by retorts or sufficiently close to elevations at which retorts are being. prepared that there could be a substantial likelihood of damage to the gas level due to nearby blasting. It is desirable that the gas collection level be positioned so that there are no other underground workings near it. It is therefore preferred that the gas collection level be at an elevation below the liquid collection level, which is at or below the bottoms of the in situ oil shale retorts.

A sump (not shown) can be provided in the gas collection drift 30, or at the bottom of the gas shaft 71, for ground water and liquid products which may enter the off gas collection system. Such products could include liquids entrained by the gaseous products. Pumps can be provided in the gas collection drift to transfer any such water and liquid products to the main sumps 58 in the liquid collection drifts.

All of the retorts serviced by a single liquid collection cross drift 22 are not necessarily used to produce gaseous and liquid products simultaneously. For example, all of the retorts in one of the two rows served by a single collection cross drift can be retorted together, and then all of the retorts in the other row can be retorted. Also, the retorts in a single row of retorts can be retorted sequentially or simultaneously, or retorts in groups of two or more can be processed together, depending upon production requirements.

In a presently preferred system for distributing process air and ventilation air, fresh air is drawn from above ground through an airway such as the service shaft 70. This air is used as process air for combustion reactions in active in situ oil shale retorts in the production region 13 and for ventilation air for workmen and equipment located either in the retort preparation region 11 or portions of the production region 13. The air distribution to the underground workings is separated from the gas level 16 so that gaseous products cannot enter the ventilation system. Fresh air drawn into the underground in situ oil shale retort system through the service shaft 70 is divided or split underground to supply retorts in the production region 13 with process air and to provide ventilation air to the remaining underground workings where men and equipment are present. A portion of the incoming air is supplied to the underground air level 12 where the air supply is split between the retort production region 13 and the retort preparation region 11. A portion of the incoming air is supplied to one or more retort access levels 17 and retort preparation cross-drifts 21 to provide ventilation during retort excavation and explosive expansion operations.

Two principal airways are provided for communicating between underground workings and above ground. The production shaft 69 exhausts ventilation air from the underground workings primarily from the liquid collection or production level 14. Air flow from the production shaft 69 is induced by a blower 75 such as an axial vane fan which maintains the air pressure in underground workings at less than ambient air pressure above ground. This causes ventilation air to be drawn in from above ground through the service shaft 70. This ventilation air is distributed in the underground workings as hereinafter described.

At least a portion of the producing retorts in the production region 13 contain fragmented masses of oil shale particles with the top boundary in air communication with the air level by passages 46 (FIG. 4). The bottoms of such active in situ retorts are connected by way of passages 48 to the isolated portion of the liquid collection level, hence indirectly to the gas level drift 30. The gas level drift connects to the product gas shaft 71 which is connected to the inlet of the centrifugal blower 76. This induces a low pressure in the gas level and withdraws off gas from the bottoms of the active in situ oil shale retorts. This, in turn, draws process air into the tops of the retorts from the cross drift 20 at the air level 12. Such process air is drawn through the service shaft 70 from above ground. Thus, fresh air drawn through the airway 70 includes both ventilation air and process air.

Some process and ventilation air can be introduced by way of the emergency exit shaft 68. In an exemplary embodiment this auxiliary shaft, which serves primarily as an emergency escape-way, is about 12 feet in diameter. The principal airway formed by the service shaft 70 is about 34 feet in diameter. Thus, more than eight times as much air is drawn into the underground workings through the principal airway as is drawn in through the auxiliary emergency ventilation shaft 68. If desired, to augment the introduction of air through the auxiliary shaft, the blower 74 can be operated, or it can be bypassed for normal operation and reserved for emergency use in the event that the gas lever blower 76 and main ventilation air blower 75 are not operating.

It is desirable to maintain the underground workings at a pressure less than ambient pressure wiht the gas level operating at a lower pressure than the underground workings in which men and equipment can be operating. By so doing, ventilation air flow is induced by the exhaust blowers 75, and process air flow is induced by the off gas blower 76. The fresh air which will serve as process air and ventilation air entering the underground workings thus does not need to pass through a blower system. It appears that a net saving of energy for effecting air and gas flow can be achieved by having blowers only on the withdrawal passages of the system.

Air flow regulators (e.g., large doors or louvers, not shown) located in the air level and the retort access levels can split air flow as desired between the production region and the retort preparation region. For example, 1.3 million SCFM of incoming fresh air can be split underground so thta about one million SCFM is used as process air for active retorts in the production region, while about 0.3 million SCFM is available for ventilation in the remaining portions of the underground workings. If desired, underground fans along with ducts, hanging tubing, portable brattices, or the like, can be used for assisting distribution of air in underground workings or distributing ventilation air to working faces.

Either of two general systems for development of an area to include a plurality of in situ oil shale retorts can be used. A partial mixture of the two is also useful. In a retreating system development, drifts and ventilation systems are developed to essentially their full extent and preparation of in situ oil shale retorts commences in a region remote from the source of fresh air. Subsequent retorts are prepared in a sequence progressing towards the source of fresh air. In an advancing system, on the other hand, retorts are prepared as air level drifts and production level or liquid collection level drifts are driven from the source of fresh air. Subsequent retorts are prepared in a sequence advancing away from the source of fresh air. Each of these systems has certain advantages and disadvantages. A disadvantage of a retreating system is the need to develop an extensive system of underground workings before any production of useful products occurs. A safe and economical system for preparing retorts while driving air level and production level drifts is desirable.

As retort preparation advances on the air level and the retort access level or levels, and the liquid collection level, vertical bypass raises 90 (see FIGS. 1 and 6) are formed between the air level drifts 20 and the production or liquid collection level drifts 22. In the system shown in the drawings, a byapss raise 90 is formed for each cluster of eight retorts. Each bypass raise 90 is offset laterally from the main passages of the air drifts, the retort access level drifts, and the production level drifts in a portion of the formation to remain as a pillar between retorts. Short upper and lower cross-drifts 92 and 94 connect each bypass raise 90 to an adjacent air level drift 20 and production level drift 22, respectively. Separate vertically spaced apart intermediate cross-drifts 96 connect each bypass raise 90 to adjacent retort access level drifts 21.

The bypass raises 90 are offset from the upper level drifts so that there are no dangerous openings in the floors of the main passageways. Each raise is offset from the lower level drift so that excavated formation or "muck" dumped through the bypass raise does not block the lower level drift.

As retort preparation advances, the bypass raises 90 are used as muck passes from the air level and retort access level drifts. Excavated formation from driving drifts and preparing voids in retorts is dumped from these drifts downwardly through the bypass raises to the production level drift 22 where it can be transported by conveyors through the production level drifts to the production shaft 69 for removal to ground level. As retort preparation and drift driving continues to advance, each bypass raise previously used as a muck pass becomes available as an essentially uninterrupted ventilation air passage between the headings of the air level drift, the retort access level drifts and the liquid collection level drift. The bypass raise used as a muck pass can also provide some circulation of ventilation air to the headings to the air level, liquid collection or production level and retort access level drifts.

As headings are driven in developing many types of underground workings, a pair of parallel drifts are driven at one level, with one of the drifts serving as an intake airway and the other drift serving as a return airway for assuring that adequate ventilation air reaches the working face at the end of each drift. As the drifts extend, air circulation at the working faces diminishes. A cross-cut is then made between the two drifts near the working faces. The permits ventilation air to circulate through the intake drift and cross-cut to the return drift. As the drifts further extend, circulation at the working faces diminishes and an additional cross-cut is made between the intake and return drifts. The previous cross-cut is closed to airflow by a brattice, bulkhead, or other stopping. Such a "double entry" system for providing ventilation of underground workings can be costly because of the extra formation that must be excavated to form the second drift and cross-cuts. It is also expensive to construct and maintain stoppings in the cross-cuts. A double entry system for providing ventilation air in underground workings is avoided by use of the verticle circulation of ventilation air provided by the muck passes 90.

Thus, as the production level or liquid collection level drift 22 and air level drift 20 are driven between the end tunnels, a series of muck passes are completed to provide vertical communication between the two levels and also to connect to intervening retort access levels. Formation excavated from a working face in the upper air level, or excavated in preparation of in situ retorts at a retort access level is dumped down the muck pass nearest the working face. Later, as the faces advance, an additional muck pass raise is formed between upper and lower levels. This new muck pass is then used for dumping excavated formation to the lower level for removal to above ground. The muck pass previously used for dumping excavated formation is then used for vertical air circulation between the upper and lower levels. Muck passes further from the working faces than the two active muck passes are plugged so that ventilation air is circulated to a region close to the working faces.

Once a bypass raise 90 has served as a muck pass and then an uninterrupted ventilation airway, the bypass raise can be plugged, as long as two unplugged bypass raises are present beyond it. The bypass raise nearest the working face serves as a muck pass, the intermediate raise serves as an unobstructed ventilation airway, and any previous bypass raises are plugged.

FIG. 6 illustrates such a procedure in which the bypass raise 90 (indicated at A) nearest the working faces 95 of the air level, liquid collection level, and retort access level drifts serves as a muck pass for formation excavated from the upper level working faces 95 and from voids excavated for forming retorts. The bypass raise indicated at B behind the raise indicated at A serves an an unobstructed ventilation airway between the headings of the air level collection level and interconnects these levels to the retort access level drifts. The bypass raises indicated at C and D are plugged so as to isolate the upper and lower levels from one another and assure that ventilation air reaches the working faces and retorts in preparation. Each bypass raise 90 is plugged by stoppages 97, 98, and 99 to block air flow between the raise and the air level, retort access levels, and production level, respectively. Stoppages 97 and 98 are illustrated below and above the air level and production level drifts, respectively, in FIG. 6 for clarity, although it is preferred to provide these stoppages in the bypass raise cross-drifts 92 and 94. Such stoppages are easily provided by dumping excavated formation particles into the raises and pouring in concrete or "guniting" the face of the resultant muck pile with sprayed concrete.

In the arrangement illustrated in FIG. 6, there are three retort access levels 21 employed in excavating voids for forming in situ oil shale retorts 18. The upper two of these retort access drifts 21 and the air level cross drift 20 are in air communication with the service shaft 70 for receiving fresh ventilation air from above ground. The lower retort access drift 21 and liquid collection level drift 22 are in air communication with the production shaft 69 through which exhaust ventilation air is withdrawn from the underground workings. Thus, in this embodiment, there are three intake airway drifts through which fresh ventilation air passes, and two return airway drifts vertically spaced from each other through which exhaust ventilation air passes. Such ventilation air passes from the upper levels of underground workings to the lower levels of underground workings by way of the bypass raise 90 indicated at B in FIG. 6. Circulation of air to the working faces 95 can be augmented by underground fans and hanging tubing from the air bypass raise 90 to a location near the working faces 95.

Once retort preparation is completed in a pair of rows of retorts, the liquid collection level drift serving them is isolated with bulkheads 54 (FIG. 1) and connected to the process off gas drift 30, and the air level is connected to the tops of the retorts by passages 46 as described above. A combustion zone is established in such retorts and retorting is commenced. The off gas blower 76 located above ground at the top of the gas withdrawal shaft 71 induces air flow into the retorts and withdraws off gas from them by way of the gas shaft 71. The off gas is withdrawn at a pressure lower than ambient air pressure above ground and also at a pressure lower than that of the ventilation and process air in other portions of the underground workings in which men and equipment are operating.

EXAMPLE

This example illustrates production of liquid and gaseous products from oil shale according to a method having features of this invention.

A site is selected in the Piceance Creek structural basin in Colorado. Three 34-feet diameter shafts are sunk downwardly into the formation. These three shafts are a production shaft 69, a service shaft 70, and a gas shaft 71. A 12-feet diameter emergency air inlet shaft 68 also is provided. A large pillar of undisturbed formations is left around each of these four shafts. Each shaft is sunk by conventional methods.

The production shaft 69 is used for removing excavated formation, ventilation exhaust, and liquid product removal and is sunk about 1750 feet deep to a liquid collection level. The production shaft is smooth-lined with concrete. The service shaft 70 serves as intake for process and ventilation air. It is smooth-lined with concrete and is sunk at least about 1750 feet deep to the liquid collection level. The gas shaft 71 also is smooth-lined with concrete. The depth of the gas shaft at the gas collection level is about 1820 feet.

The formation is developed in panels, each panel consisting of four rows of clusters 62, with eight clusters per row. Each cluster 62 consists of eight retorts 18, the retorts being aligned in rows of two by four. Each retort is 200 feet square by 310 feet high and separated from adjacent retorts by pillars 64 about twenty-five feet thick. Pillars 66 are provided between clusters and are about fifty feet thick.

An air level 12, a liquid collection or production level 14, and a gas collection level 16 are prepared in the formation. The air level is at an elevation of 1290 feet below ground surface, the liquid production level is at an elevation of 1750 feet below ground surface, and the gas level is at an elevation of 1810 feet below ground surface. Air drifts 20, which are about thirty feet square, are driven over the pillars 66 between clusters at a distance of about fifty-five feet above the top boundaries of the retorts. Since the air drifts 20 are driven over the pillar between rows of clusters, two rows of retorts can be serviced from one air drift. Raises or air passages 46 are drilled downwardly into the retorts to be formed for introduction of air into the retorts during the production operation.

Similarly, liquid collection level cross drifts about thirty feet wide by twenty feet high are driven under the pillars 66 between two rows of clusters about eighty-five feet below the bottom boundaries of the retorts. At each end of each liquid collection cross drift 22 there is a main collection drift 24 which is about thirty feet wide by twenty feet high. From the cross drifts, stubs about twenty feet by twenty feet are driven to directly below the center of each retort. Several holes are fan drilled upwardly into each retort bottom from a stub. The bypass raises 90 are about ten feet in inside diameter.

The gas level comprises a single drift 30 about thirty feet by thirty feet driven from the gas shaft 71. Alternatively a temporary ramp can be excavated from the liquid level for driving the gas collection drift, and later sealed to dedicate the gas level. The gas collection drift 30 extends underneath the center points of the cross drifts of the liquid collection level. There is a thirty feet long raise for each cross drift of the liquid collection system to connect each such cross drift to the gas level drift.

The gas level is dedicated to collection of gaseous products and no access is needed for the life of the panel. A stub drift having a stoppage can be provided connecting to the gas level drift 30 for future access to the gas collection level for additional panels.

The upper boundary of each of the retorts to be formed is about forty-five feet below the air level, and the bottom boundary of each of the retorts is about 105 feet above the liquid collection level. About 20 to 25% of the formation within the boundaries of a retort to be formed is excavated to the liquid collection level and withdrawn through the production shaft to above ground for forming at least one void in the retort site. The remaining formation within the boundaries of the retort to be formed is explosively expanded toward such a void and fragmented to yield a fragmented permeable mass of formation particles in each retort.

After formation of the in situ retorts served by a single cross drift of the liquid collection system, the cross drift is bulkheaded at each end, and a combustion zone is established in one or more of the retorts served by the cross drift 22. The combustion zone is advanced downwardly through the retort by introduction of air via the service shaft 70 and the air level 12. Preferbly the air is diluted with steam. Heat is transferred to a retorting zone on the advancing side of the combustion zone wherein retorting of kerogen in the oil shale occurs, with production of gaseous and liquid products. The liquid and gaseous products are withdrawn to the liquid collection level 14 and, from there, the gaseous products are withdrawn to the gas collection level 16. Liquid products are then transferred to above ground via the production shaft 69 and gaseous products are withdrawn to the surface via the product gas shaft 71.

By recovering liquid and gaseous products from oil shale in a subterranean formation containing oil shale according to the method of this invention, personnel engaged in preparation of retorts and personnel engaged in operating active retorts are protected from noxious gases produced by retorting oil shale. Such protection results from using a dedicated gas collection drift system and by maintaining a pressure in the gas collection drift system lower than the pressure in the retort preparation region of the formation and the region to the formation where retort operating personnel are working. Also, the presence of a buffer region or zone of retorts containing a fragmented permeable mass of formation particles between active retorts and the retort preparation region helps prevent gaseous products from reaching operating and retort preparation personnel.

What is claimed is:

1. A method for recovering liquid and gaseous products from a plurality of in situ oil shale retorts in a subterranean formation containing oil shale, such an in situ oil shale retort containing a fragmented permeable mass of formation particles containing oil shale, the method comprising the steps of:

excavating an upper level of underground workings;

excavating a first inlet airway between above ground and at least the upper level of underground workings;

excavating a lower level of underground workings at an elevation below the elevation of the upper level of underground workings;

excavating a second exhaust airway between above ground and at least the lower level of underground workings ;

establishing air communication between the upper level of underground workings and the lower level of underground workings;

withdrawing ventilation air under pressure from the exhaust airway for drawing ventilation air from above ground through the inlet airway, through the upper level of underground workings, through the air communication between the upper level of underground workings and the lower level of underground workings, and through the lower level of underground workings into the exhaust airway;

forming a plurality of in situ oil shale retorts, each of said retorts having a top boundary at an elevation below the elevation of the upper level of underground workings, a bottom boundary at an elevatin at or above the elevation of the lower level of underground workings and containing a fragmented permeable mass for formation particles containing oil shale;

establishing air communication between the upper level of underground workings and the top boundary of each of plurality of such in situ oil shale retorts;

establishing a combustion zone in each of a plurality of such in situ oil shale retorts having air communication with upper level of underground workings;

withdrawing process off gas containing gaseous products under pressure from the bottom boundaries of such a plurality of in situ oil shale retorts having combustion zones therein for drawing process air through the inlet airway and through the upper level of underground workings into such in situ oil shale retorts for advancing such a combusion zone downwardly through such a fragmented mass for retorting oil shale therein, wherein said process off gas is withdrawn from-the in situ retorts at a pressure lower than air pressure in the upper and lower level of underground workings; and withdrawing liquid products from the bottom boundary of such in situ retorts having a combustion zone therein.

2. A method for providing ventilation air for underground workings and providing process air for a plurality of in situ oil shale retorts in a subterranean formation containing oil shale, each of said retorts containing a fragmented permeable mass of formation particles containing oil shale, comprising the steps of:

withdrawing ventilation air under pressure from underground workings at a first pressure lower than ambient pressure above ground; and withdrawing process off gas under pressure from a plurality of such in situ oil shale retorts at a second pressure lower than the air pressure in the underground workings for drawing process air from the underground workings into such in situ oil shale retorts, for inducing fresh air to flow from above ground into the underground workings for use as ventilation air in the underground workings and as process air in the in situ oil shale retorts.

3. A method of ventilating underground workings in a subterranean formation containing oil shale and containing a three-dimensional matrix of underground workings comprising the steps of:

providing a first airway from above ground to underground workings at an upper level in the formation;

providing a second airway from above ground to underground workings at a lower level in the formation;

providing vertical air communication between upper and lower levels remote from the first and second airways:

withdrawing ventilation air under pressure from the second airway for constantly drawing fresh air from above ground through the first airway, through the upper and lower levels of the underground workings, and through the vertical air communication therebetween; and withdrawing process off gas under pressure from a plurality of in situ oil shale retorts each having a combustion zone advancing through a fragmented permeable mass of particles containing oil shale, the process off gas being withdrawn at a lower pressure than air pressure in the underground workings at the upper level and lower level, said retorts being in air communication with the underground workings at a level in the formation on the trailing side of such a combustion zone, for constantly drawing fresh air from above ground, through the first airway, and into said in situ retorts.

4. A method according to claim 3 including operating an induction fan above ground at the second airway to draw fresh air through the first airway.

5. A method according to claim 3 further comprising the step of:

isolating a portion of the lower level of underground workings in gas communication with the advancing side of such a combustion zone from another portion of the lower level of underground workings in air communication with the second airway.

6. A method of providing ventilation air for underground workings and process air for a plurality of in situ oil shale retorts in a subterranean formation containing oil shale, each of said retorts containing a fragmented permeable mass of formation particles containing oil shale, the method including the steps of:

forming a first airway in an upper level of the formation;

forming a plurality of such in situ oil shale retorts in the formation at an elevation lower than the elevation of the first airway, upper portions of such retorts being in air communication with the first airway;

forming a second airway in a lower level of the formation;

providing vertical air communication between the first and second airways;

forming a gas collection level in fluid communication with lower portions of such in situ oil shale retorts for withdrawing off gas from the retorts;

withdrawing off gas under pressure from such retorts through the gas collection level at a first gas pressure below ambient air pressure above ground to constantly draw fresh air from above ground through the first airway into such retorts; and withdrawing air under pressure from the second airway constantly draw fresh air from above ground through the first airway to the underground workings, the fresh air being at a second pressure between ambient air pressure above ground and said first gas pressure.

7. A method according to claim 6 including forming a raise to provide the vertical air communication between the first and second airways, excavating subterranean formation in preparation for forming an in situ oil shale retort, passing excavated formation down the raise to the second airway for removal to above ground, and thereafter drawing air through the raise to ventilate underground workings during further excavation.

8. A method according to claim 6 including excavating underground formation in preparation for forming an in situ oil shale retort, and removing excavated formation via the second airway.

9. An air distribution system in a subterranean in situ oil shade formation having underground workings in a retort preparation region of the formation and a plurality of in situ oil shale retorts, in a production region of the formation, each of said retorts containing a fragmented permeable mass of formation particles containing oil shale, the air distribution system comprising:

an air delivery drift system extending through an upper level of the formation to the retort preparation region and the production region;

a liquid collection drift system extending through a lower level of the formation to the retort preparation region and the production region for use in removing excavated formation from the retort preparation region and for removing liquid products from the production region;

a first airway leading between the air delivery drift system and above ground;

a second airway leading between the liquid collection drift system and above ground;

at least one vertically extending bypass raise in the retort preparation region in air communication between the air delivery drift system and the liquid collection drift system;

means for withdrawing air under pressure from the second airway to induce fresh air to flow from above ground through the first airway under a pressure lower than ambient air pressure above ground; and circulating a ventilation portin of induced air flow through the air drift system, through such a bypass raise, and through the liquid collection drift system to ventilate the retort preparation region and to remove exhaust ventilation air through the second airway; and means for withdrawing process off gas under pressure from a plurality of such in situ retorts which are in air communication with the air delivery drift system circulating a process portion of induced fresh air flow through the air drift system to in situ retorts in the production region.

10. A system according to claim 9 including means for isolating gas flow in the liquid collection drift system of the production region from air flow in the liquid collection drift system of the retort preparation region.

11. A system according to claim 10 including a gas collection drift system in the production region for withdrawing process off gas from the retorts, a third gas way extending between the gas collection drift system and above ground, and in which the means for withdrawing process off gas withdraws the off gas from the third gas way to induce process air to flow through the air delivery drift system to retorts in the production region and through the gas collection drift system at a gas pressure lower than that of ventilation air in the retort preparation region.

12. A system according to claim 11 including a fourth airway extending from above ground to at least the air delivery drift system and means for forcing air under pressure greater than ambient air pressure above ground through the fourth airway to at least the air delivery drift system.

13. A method of forming an advancing row of in situ oil shale retorts in a subterranean formation containing oil shale comprising the steps of:

forming an underground air drift at an upper elevation in the formation;

forming an underground production drift at a lower elevation in said formation vertically spaced apart from the upper air drift;

forming a first raise between the upper air drift and the lower production drift for providing vertical ventilation air communication between the drifts;

excavating formation from a portion of the formation adjacent the first raise to form at least one void for forming a first in situ oil shale retort;

passing excavated formation particles down through the first raise to the lower level production drift;

forming a second raise between the upper air and lower production drifts beyond the site of said first retort; and thereafter excavating formation from a portion of the formation adjacent the second raise to form at least one void for forming a second in situ oil shale retort; and passing excavated formation particles down through the second raise to the lower level production drift; while passing ventilation air through the first raise between the upper level air drift and the lower level production drift.

14. A method according to claim 13 including the steps of:

forming a third raise between the upper level air drift and the lower level production drift beyond the second retort; and thereafter plugging the first raise;

excavating formation from a portion of the formation adjacent the third raise to form at least one void for forming a third in situ oil shale retort; and passing excavated formation particles down through the third raise to the lower level production drift; while passing air through the second raise between the upper level air drift and the lower level production drift.

15. A method according to claim 14 including plugging the first raise with excavated formation particles and concrete.

16. A method according to claim 13 including drawing exhaust ventilation air circulated through such a raise at a first above ground location at a pressure lower than ambient air pressure, thereby drawing fresh air from a second above ground location through the first raise.

17. A subterranean in situ oil shale retort system comprising:

a plurality of in situ oil shale retorts each containing a fragmented permeable mass of formation particles containing oil shale;

an air delivery drift system in an upper level of the formation at an elevation above such retorts;

a liquid collection drift system at an elevation below the air delivery drift system for withdrawing excavated formation particles and for withdrawing liquid products from the retorts; p1 means for providing ventilation air communication between the air delivery drift system and the liquid collection drift system;

a gas collection drift system in gas communication with the bottoms of such retorts;

means for introducing air from the air delivery drift system to the tops of such retorts;

means for withdrawing process off gas under pressure from such retorts by way of the gas collection drift system at a first pressure below ambient air pressure above ground for drawing process air into such retorts from the air delivery drift system; and means for withdrawing ventilation air under pressure from the liquid collection drift system at a second pressure between ambient air pressure above ground and the pressure in the gas collection drift system for providing a flow of ventilation air from the air delivery drift system through the means for providing air communication to the liquid collection drift system.

18. A subterranean in situ oil shale retort system according to claim 17 including an exhaust ventilation shaft in air communication with the liquid collection drift system, and an induction fan in the exhaust ventilation shaft to draw ventilation air at lower than ambient pressure through underground workings of the retort system.

19. A subterranean oil shale retort system according to claim 17 including a first air inlet airway open to the atmosphere and in air communication with the air delivery drift system, a second ventilation exhaust airway in air communication with the liquid collection drift system and having fan means for drawing ventilation air at a pressure lower than ambient air pressure above ground through the first airway and through the underground workings of the retort system.

20. A subterranean oil shale retort systems according to claim 19 comprising a production region having a plurality of said retorts each containilng a fragmented permeable mass of formation particles containing oil shale, and a retort preparation region having underground workings in which in situ oil shale retorts are being prepared; and including means for preventing gas flow from the gas collection drift system to the retort preparation region.

21. A method of forming an advancing row of in situ oil shale retorts in a subterranean formation containing oil shale, each of said retorts containing a fragmented permeable mass of formation particles containing oil shale, the method comprising the steps of:

excavating an upper air level drift in the formation;

excavating a lower production level drift at a lower level in said formation below the air level drift;

excavating a first raise between the air level drift and the production level drift for providing air communication between the air level and the production level drift;

excavating a second raise between the air level drift and the production level drift;

excavating formation particles from within a portion of the formation to become an in situ oil shale retort;

passing the excavated formation down through the second raise to the production level drift;

removing excavated formation from the production level drift to above ground; and introducing ventilation air to the air level drift by withdrawing air under pressure from the production level drift for inducing air flow downwardly through the first raise.

22. The method according to claim 21 further comprising the steps of:

excavating a retort level access drift at a level between the air level drift and the production level drift; and excavating formation from within the portion of the formation to become an in situ oil shale retort for forming a void therein.

23. A system according to claim 11 in which the gas collection drift system is at a level below the level of the liquid collection drift system.

24. A system according to claim 12 in which the gas collection drift system is at a level below the level of the liquid collection drift system.

25. A system according to claim 17 in which the gas collection drift system is in gas communication with the retorts via gas communication with the liquid collection drift system.

26. A system according to claim 25 in which the gas collection drift system is at a level below the level of the liquid collection drift system.

* * * * *